US005214434A

United States Patent [19]

Hsu

[11] Patent Number: 5,214,434

[45] Date of Patent: May 25, 1993

[54] MOBILE PHONE ANTENNA WITH IMPROVED IMPEDANCE-MATCHING CIRCUIT

[76] Inventor: Wan C. Hsu, No. 7, Lane 290, Nan Shan Rd., Kuei San Hsiang, Tao, Yuan Hsien, Taiwan

[21] Appl. No.: 884,716

[22] Filed: May 15, 1992

[51] Int. Cl.[5] ..... H01Q 1/24

[52] U.S. Cl. ..... 343/702; 343/749; 343/906

[58] Field of Search ..... 343/702, 749, 878, 906, 343/898, 850, 860, 862, 745, 715

[56] References Cited

U.S. PATENT DOCUMENTS 3,579,241 5/1971 Antista ..... 343/702

4,024,542 5/1977 Ikawa et al. ..... 343/702

*Primary Examiner*—Rolf Hille

*Assistant Examiner*—Hoanganh Le

*Attorney, Agent, or Firm*—W. Wayne Liauh

[57] ABSTRACT

A new antenna structure for a mobile phone mainly comprises an antenna stem, a swivel joint, a high-frequency connector, and an impedance-matching member; the swivel joint includes an antenna-mounting base, a joint-fastening base and an outer protection sleeve; the swivel joint has a very small height in the whole antenna structure; the swivel joint enables the extension antenna stem to turn freely, and to bend for storage and carrying, if necessary. The copper and spring-shaped impedance-matching member and a copper sleeve wall of the high-frequency connector form into an impedance-matching circuit; the impedance-matching member is made of a standard parts without test and adjustment so as to facilitate the assembling operation thereof, and to provide a stable reception function.

1 Claim, 5 Drawing Sheets

MOBILE PHONE ANTENNA WITH IMPROVED IMPEDANCE-MATCHING CIRCUIT

BACKGROUND OF THE INVENTION

Mobile phones have become a popular communication equipment in our daily life. The main body of the phone becomes smaller and smaller in size to facilitate carrying around by a user; however, the antenna of a mobile phone has, so for, no any improvement, such as the length of the antenna is unable to vary and having a poor reception function, which are deemed drawbacks thereof. Even an extension antenna is still deemed too long to meet the requirement after being retracted into a short one. If a connector of an antenna is added thereto, the whole length of an antenna is still too long to carry or for storage. The antenna might be bent at an angle of 90 degrees for shortening its length; unfortunately, the reception function would be affected as a result of no perfect high-frequency connector being available, and therefore no such antenna is used. Generally, a flexible rod antenna is used on a mobile phone, but the length of such an antenna is still deemed too long. Since the phone signal is a high frequency signal, the impedance-matching member has to be adjusted and tested carefully before being installed in place; such adjusting and testing procedures have become a bottleneck in the assembling line, aside from the lack of quality assurance of the impedance-matching circuit and the reception poor result.

SUMMARY OF THE INVENTION

This invention relates to a new antenna structure of a mobile phone, which comprises an antenna stem, a swivel joint, a high-frequency connector and an impedance-matching member. The swivel joint includes an antenna-mounting base, a joint-fastening base and an outer protection sleeve, and the height thereof in the whole antenna is a low percentage. The swivel joint and the extension antenna stem can facilitate the antenna to turn, bend, and to retract for storage and carrying. The impedance-matching member, which is made of copper, and the sleeve wall of the high-frequency connector form an impedance-matching circuit. The prime feature of the present invention is that the drawbacks of the conventional mobile phone have been ameliorated according to the present invention; the swivel joint that includes the antenna-mounting base, the joint-fastening base and the outer protection sleeve constitute only a very short length affixed to the phone. The swivel joint and the extension antenna rod enable the antenna to turn and to bend for facilitation of storage and carrying. The spring-shaped impedance-matching member made of copper and the sleeve wall of the high-frequency connector form into an impedance-matching circuit. The spring-shaped impedance-matching member makes the assembling procedures simple without test and adjustment, and still can provide a stable reception result.

BRIEF DESCRIPTION OF THE DRAWINGS

FIGS. 3-1, 3-2 and 3-3 illustrate the assembled structure of the swivel joint according to the present invention.

DETAILED DESCRIPTION

Figure 1:
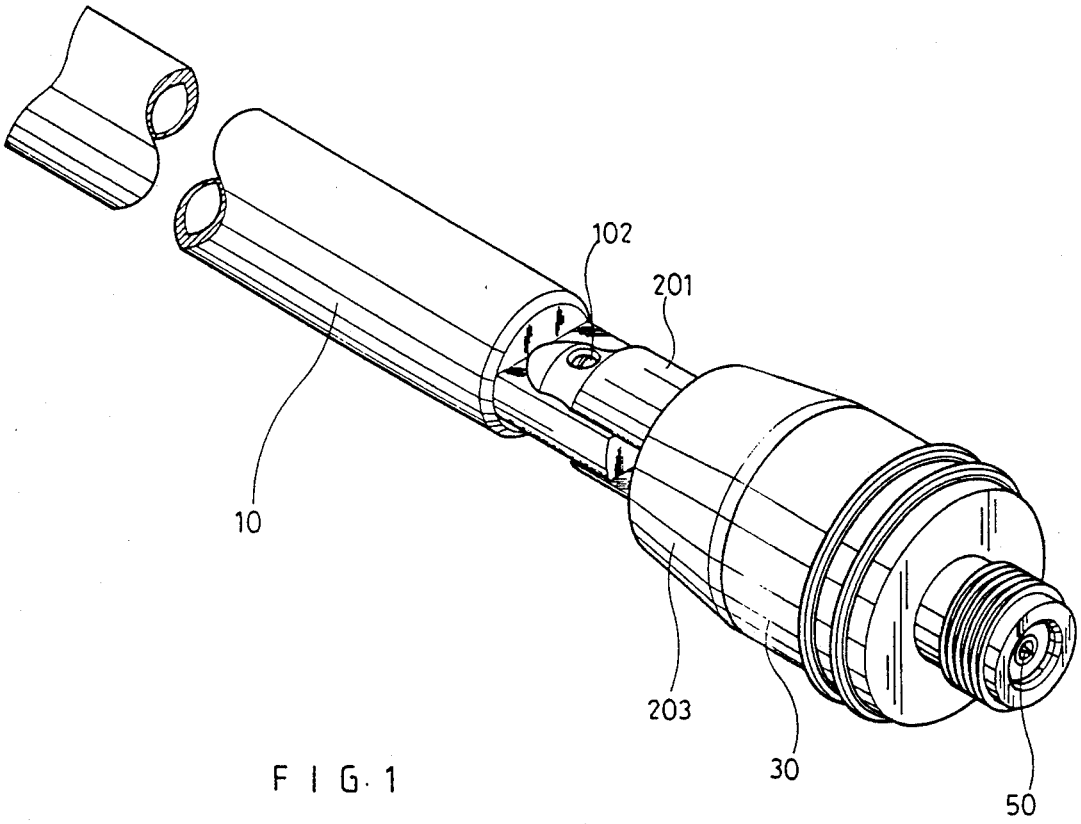
FIG. 1 is a perspective view of an embodiment according to the present invention.
Figure 2:
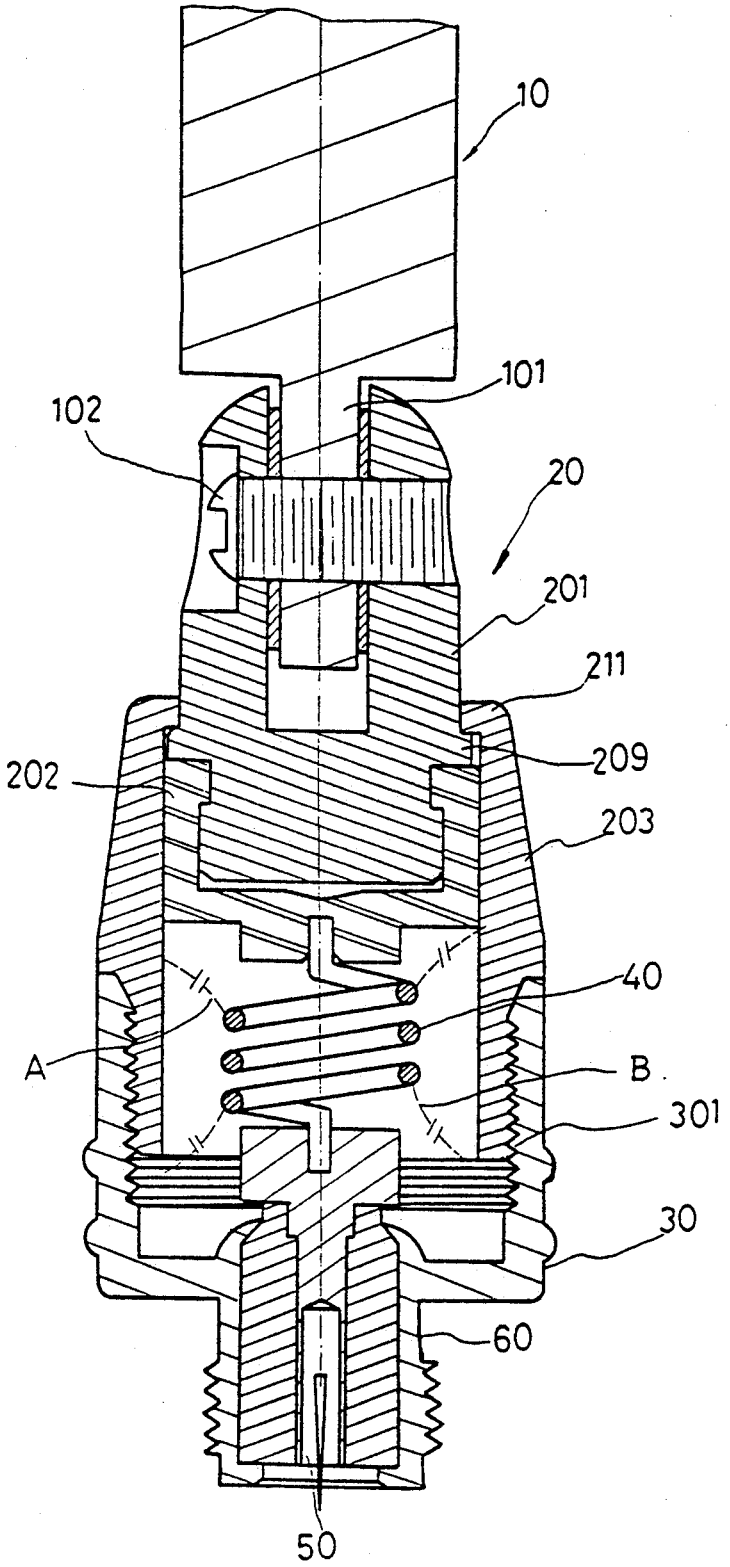
FIG. 2 is a sectional view of the present invention.
Figures 2, 3:
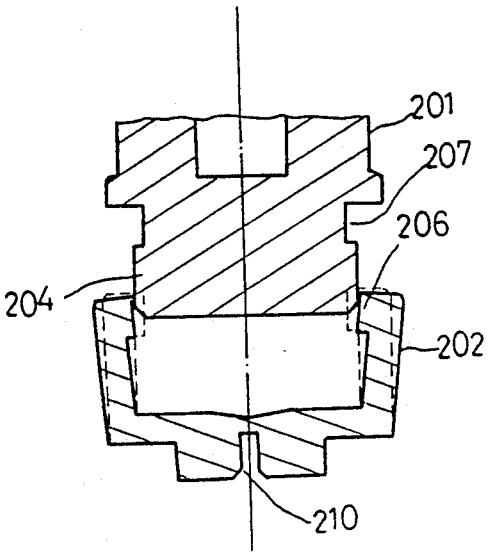
Figure 3:
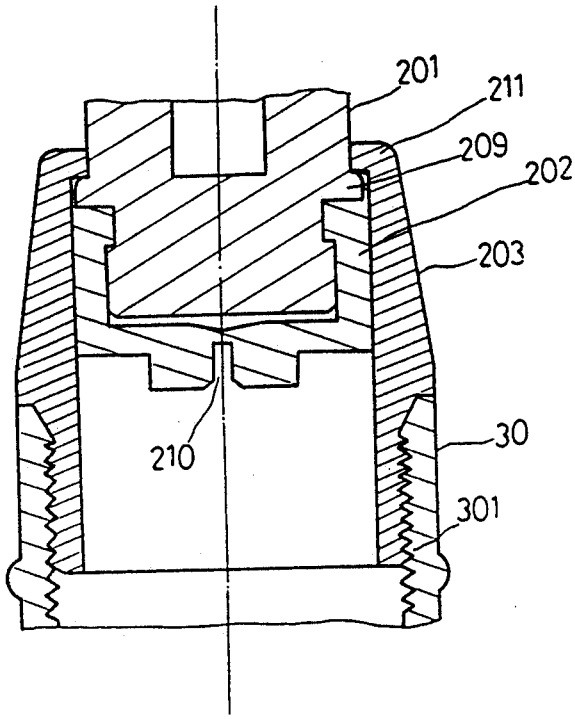
Figures 1, 3:
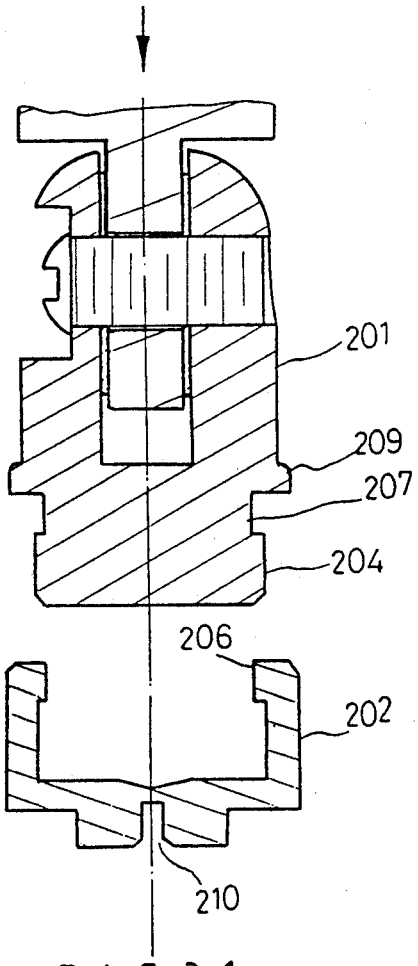
Figure 4:
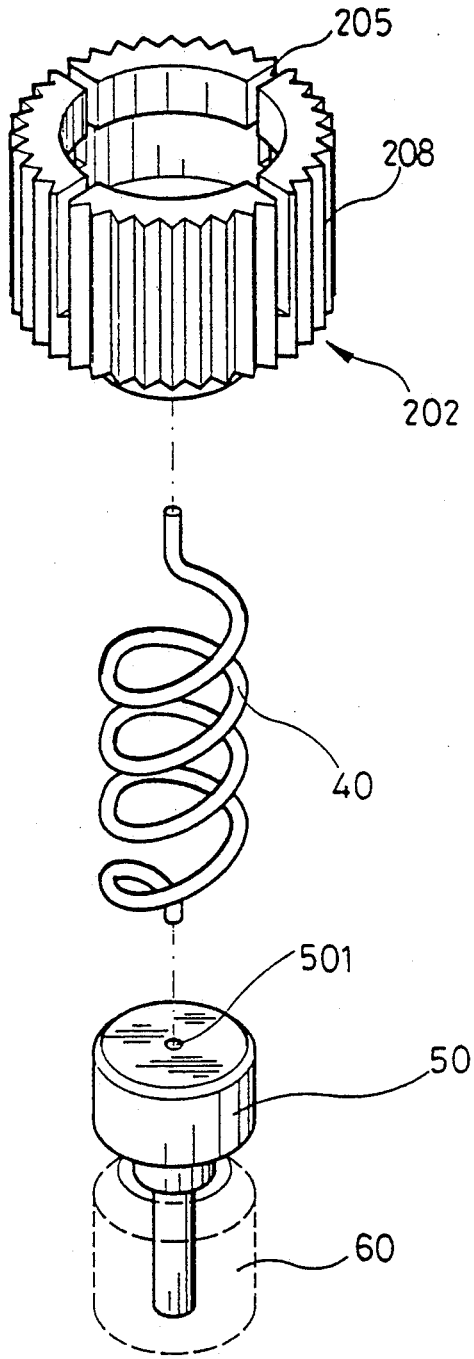
FIG. 4 illustrates an impedance-matching member (inductance coil) in the present invention.

The present invention is further described in detail with the accompanying drawings as follows:

Referring to FIGS. 1 and 2, the two FIGS. show a perspective view and a sectional view of the present invention respectively. The present invention comprises an extension antenna stem 10, a swivel joint 20, a high-frequency connector 30, and an impedance-matching member 40. The swivel joint 20 includes an antenna-mounting base 201, a joint-fastening base 202 and an outer protection sleeve 203. The lower end 101 of the extension antenna stem 10 is mounted with a lock screw 102 which is fixedly fitted in the upper end of the antenna-mounting base 201. The lock screw 102 is rotatably in the same direction as that of the antenna-mounting base 201 so as to have the antenna aligned in the signal direction. The lower end of the antenna-mounting base 201 is formed into a cylindrical stud 204 (as shown in FIG. 3-1). When the cylindrical stud 204 is pressed downwards, the joint-fastening base 202 having four or more vertical slots 205 (as shown in FIG. 4) will be opened slightly (as shown in FIG. 3-2). As soon as the cylindrical stud 204 is pushed to the bottom of the joint-fastening base 202, the fastening ring 206 of the joint-fastening base 202 will restore to its original shape to engage with a retaining groove 207 of the antenna-mounting base 201 so as to have the two parts fastened together. The outer surface of the joint-fastening base 202 is furnished with a plurality of vertical slip-proof threads 208, which can prevent the base 202 from slipping and rotating after the base being inserted inside the outer protection sleeve 203. As soon as the antenna-mounting base 201 is inserted into the upper part of the outer protection sleeve 203, a fastening ring 211 on the upper end of the outer protection sleeve 203 will be engaged with a circular flange 209 of the antenna-mounting base 201; then, the base 201 mated with the joint-fastening base 202 and the outer protection sleeve 203 can be turned horizontally. Since the antenna stem 10 can be turned vertically, the whole antenna can then be turned freely in all three dimensions. The bottom of the joint-fastening base 202 has a small hole 210 for receiving the upper end of a spring shaped copper impedance-matching member (an inductance coil), which is soldered in place (as shown in FIG. 4); the lower end of the impedance-matching member 40 is inserted in a mounting hole 501 of a center-needle seat 50. The seat 50 is mounted around with an insulation collar 60, which is then mounted on the bottom part of a high-frequency connector 30. The insertion method for the impedance-matching member is used in this part because of being difficult to solder the same in place. The impedance-matching member (inductance coil) 40 is to be made by using a method of making a spring member according to a given specification therefor so as to provide a standard electric characteristics desired. Between the impedance-matching member 40 and the sleeve wall 301 of the high-frequency connector 30, an electrostatic capacitance is establish (shown in FIG. 2 as A and B), and can provide a high frequency transmission; therefore, a better high frequency-matching circuit is formed for obtaining better assembling procedures and reception result than the conventional high-frequency connector.

Figure 5:
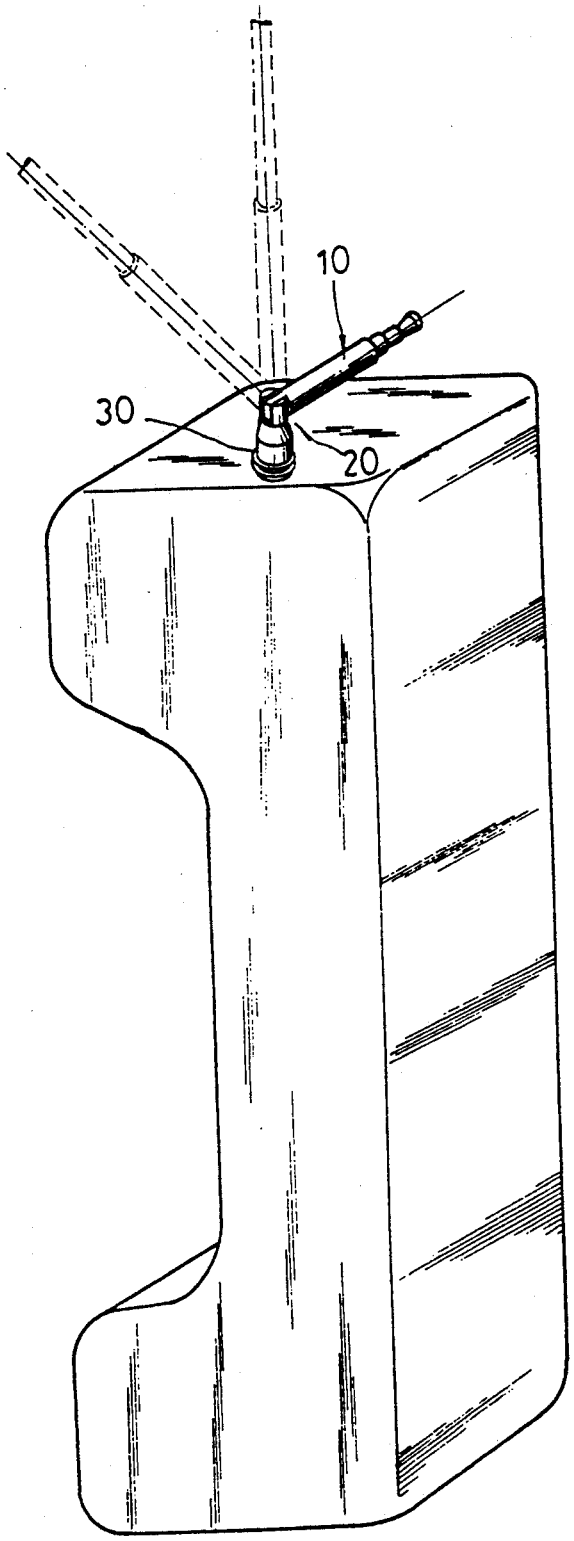
FIG. 5 illustrates the antenna of the present invention, being turned and recovered conditions.

In brief, the antenna according to the present invention can be recovered and adjusted freely as a result of its special and novel design; the antenna can be retracted into a short piece (as shown in FIG. 5); such feature is unable to find in the conventional mobile phone. The present invention is convenient to a user upon putting a mobile phone in storage condition; moreover, the antenna according to the present invention can adjusted in various directions without affecting the reception result of the mobile phone. Since the impedance-matching member (inductance coil) of the present invention is formed as a spring with a uniform size, it can facilitate the assembling work thereof without any adjustment and test. The lower end of the impedance-matching member can simply be inserted in place, the assembling work thereof can be done quickly and accurately. Since the impedance-matching member and the sleeve wall can form into an electrostatic capacitance therebetween, and provide a high frequency transmission means for better reception result; such a structure is deemed mach superior to the conventional structure which has only a coil.

I claim:

1. An antenna structure for mobile phones, comprising:

an antenna stem, a swivel joint, a high-frequency connector and an impedance-matching member;

said swivel joint including an antenna-mounting base, a joint-fastening base and an outer protection sleeve, said antenna-mounting base having an upper end and a lower end;

said antenna stem being adapted to be fastened to the upper end of said antenna-mounting base, wherein the bottom end of said antenna-mounting base being adapted to be inserted into said joint-fastening base, and both said antenna mounting base and said joint-fastening base being mounted inside said outer protection sleeve, said outer protection sleeve containing retaining means to prevent said antenna mounting base and said joint-fastening base from being disengaged from each other;

said high-frequency connector containing an insulation collar and a center-needle seat fixedly mounted therein, said center-needle seat being mounted on top of said insulation collar which insulates said center-needle seat from said high-frequency connector, said center-needle seat having a mounting hole formed on top thereof, said high-frequency connector further containing a sleeve wall for threadably sleeving about said protection sleeve;

said impedance-matching member having an upper end and a lower end; the upper end of said impedance-matching member being fixedly attached to the bottom of said joint-fastening base, while the lower end thereof being inserted into said mounting hole on said center-needle seat;

the lower end of said antenna-mounting base being shaped like a cylindrical stud having a circumferential retaining groove for engaging with said joint-fastening base and a circumferential flange on top thereof for engaging with said outer protection sleeve via said retaining means;

said joint-fastening base having a plurality of vertical slots on its upper portion to provide contractability thereof and allow said joint-fastening base to pivotably engage with said antenna-mounting base, a mounting hole on its lower portion for receiving said impedance-matching member, and a plurality of vertical slip-proof threads on the outer surface thereof to prevent slipping and rotating with respect to said protection sleeve;

said impedance-matching member being shaped like a spring and having a pre-determined electric characteristic whereby said impedance-matching member and said sleeve wall of said high-frequency connector form a predetermined electrostatic capacitance to facilitate high frequency transmission.

* * * * *